US009873007B2

(12) United States Patent
Al-Hebshi et al.

(10) Patent No.: US 9,873,007 B2
(45) Date of Patent: Jan. 23, 2018

(54) FIRE EXTINGUISHING SYSTEM

(71) Applicants: Abdulrahman A. Al-Hebshi, Bronx, NY (US); Abdo Al-Yousefy, Bronx, NY (US)

(72) Inventors: Abdulrahman A. Al-Hebshi, Bronx, NY (US); Abdo Al-Yousefy, Bronx, NY (US)

( * ) Notice: Subject to any disclaimer, the term of this patent is extended or adjusted under 35 U.S.C. 154(b) by 282 days.

(21) Appl. No.: 14/931,157

(22) Filed: Nov. 3, 2015

(65) Prior Publication Data

US 2016/0121148 A1 May 5, 2016

Related U.S. Application Data

(60) Provisional application No. 62/074,324, filed on Nov. 3, 2014.

(51) Int. Cl.

| | |
|---|---|
| ***A62C 35/10*** | (2006.01) |
| ***A62C 37/11*** | (2006.01) |
| ***A62C 35/02*** | (2006.01) |

(52) U.S. Cl.

CPC ..... *A62C 35/10* (2013.01); *A62C 35/023* (2013.01); *A62C 37/11* (2013.01)

(58) Field of Classification Search

CPC ..... A62C 35/023; A62C 37/11; A62C 11/00; A62C 13/20; A62C 13/22; A62C 13/64; A62C 19/00; A62C 3/0228; A62C 3/025; A62C 8/005; B64D 1/16

USPC ..... 169/30, 71, 36, 61

See application file for complete search history.

(56) References Cited

U.S. PATENT DOCUMENTS

| | | | | | |
|---|---|---|---|---|---|
| 1,565,036 | A | * | 12/1925 | Tank | A62C 8/005 169/26 |
| 2,515,832 | A | * | 7/1950 | Mournaud | A62C 8/005 169/28 |
| 3,065,179 | A | * | 11/1962 | Munday | C07C 39/15 508/527 |
| 3,117,521 | A | * | 1/1964 | Reaves | F42B 12/50 102/368 |
| 4,585,069 | A | | 4/1986 | Whitaker | |
| 4,696,347 | A | * | 9/1987 | Stolov | A62C 3/00 102/365 |
| 5,669,449 | A | | 9/1997 | Polan et al. | |
| 7,806,195 | B2 | | 10/2010 | Popp et al. | |
| 8,602,118 | B2 | | 12/2013 | Pigeon | |

(Continued)

*Primary Examiner* — Justin Jonaitis

(74) *Attorney, Agent, or Firm* — Global Intellectual Property Agency, LLC; Jordan Sworen

(57) ABSTRACT

An automatic fire extinguishing system is provided. The fire extinguishing system includes a housing having a detection assembly and a dispensing assembly. The detection assembly includes one or more sensors, such as infrared sensors configured to detect a fire. The fire extinguishing system emits an audible alarm through a speaker system upon detection of a fire. Further, the dispensing assembly is configured to eject a plurality of fire extinguishing balls towards a fire via compressed air. The dispensing assembly includes a reservoir configured to support the plurality of fire extinguishing balls, an air tank filled with compressed air, a valve electrically connected to a microprocessor, and a barrel. The air tank is in fluid communication with the barrel via the valve, whereby compressed air is released from the air tank to propel a fire extinguishing ball through the barrel to be ejected towards a fire.

15 Claims, 3 Drawing Sheets

(56) References Cited

U.S. PATENT DOCUMENTS

| | | | | |
|---|---|---|---|---|
| 2003/0009046 | A1* | 1/2003 | Bingel | C07B 37/04<br>556/436 |
| 2006/0049276 | A1 | 3/2006 | Ivy | |
| 2008/0289831 | A1* | 11/2008 | Kaimart | A62C 19/00<br>169/36 |
| 2016/0067533 | A1* | 3/2016 | Eriomenco | A62C 8/005<br>169/45 |

* cited by examiner

FIRE EXTINGUISHING SYSTEM

CROSS REFERENCE TO RELATED APPLICATION

This application claims the benefit of U.S. Provisional Application No. 62/074,324 filed on Nov. 3, 2014. The above identified patent application is herein incorporated by reference in its entirety to provide continuity of disclosure.

BACKGROUND OF THE INVENTION

Field of the Invention

The present invention relates to fire protection systems. More specifically, the present invention pertains to an improved fire extinguishing system configured to detect a fire and dispense a plurality of fire extinguishing balls towards a fire in order to extinguish the same.

Fire protection is important in mitigating the effects of potentially destructive fires. Fires are typically classified under classes, which aid in deciding the proper fire protection appropriate for any given situation. Under North America classifications, fires that involve flammable solids such as wood, cloth, rubber, paper and some types of plastics are classified as Class A. Fires that involve flammable liquids such as gasoline, oil, and paint are classified under Class B. Fires that involve flammable gases, such as natural gas, hydrogen, propane, and butane are also classified under Class B. Fires that involve combustible metals, such as sodium, magnesium, and potassium are classified under Class D. Fires that involve any of the materials found in Class A and Class B fires, but with the introduction of electrical wiring are classified under Class C. Finally, fires involving cooking fats and oils are classified under Class K. Some fire extinguishing agents can be used on more than one class of fire, however, other extinguishing agents have warnings where it would be dangerous for the operator to use a particular fire extinguishing agent for a specific class of fire.

Fire protection is typically achieved via three general methods: passive fire protection, active fire protection, and education. Passive fire protection involves the installation of firewalls and fire rated floor assemblies to form fire compartments intended to limit the spread of fire, high temperatures, and smoke. Active fire protection describes manual and automatic detection and suppression of fires, such as sprinkler systems and fire alarm systems. Lastly, education is the passing of information regarding the passive fire protection systems and the active fire protection systems to building owners, occupants, emergency personnel, and others so that they have a working understanding of these systems along with proper reaction during a fire related emergency.

Some active protection systems include fire alarm systems, which are electronic devices that are used to detect and alert people through visual and audio appliances when smoke/fire is present. These alarms may be activated from smoke detectors, heat detectors, water flow sensors, which are automatic or from a manual fire alarm pull station. Other active protection systems include fire sprinkler systems that discharge water when the effects of a fire have been detected, such as when a heat detector detects when a predetermined temperature has been exceeded. However, these common fire alarm systems and fire sprinkler systems do not eject fire extinguishing balls configured to extinguish fires.

The present invention provides a fire extinguishing system having a housing that encloses a detection assembly and a dispensing assembly. The detection assembly includes at least one sensor, a microprocessor, and a speaker system, wherein the detection assembly is configured to detect a fire and emit an audible alarm. The dispensing assembly is configured to directionally eject a plurality of fire extinguishing balls towards a fire upon detection by the sensor. The dispensing assembly comprises a reservoir configured to support a plurality of fire extinguishing balls, an air tank filled with compressed air, a valve and a barrel, wherein the microprocessor is configured to actuate the valve and release compressed air from the air tank through the barrel. In this way, the fire extinguishing ball lodged within the barrel is pushed through to be ejected out an end of the barrel towards a fire.

SUMMARY OF THE INVENTION

In view of the foregoing disadvantages inherent in the known types of fire extinguishing systems now present in the prior art, the present invention provides a new and improved fire extinguishing system wherein the same can be utilized for detecting and extinguishing a fire without user intervention or activity.

It is therefore an object of the invention to provide a new and improved fire extinguishing system that has all of the advantages of the prior art and none of the disadvantages.

Another object of the present invention is to provide a new and improved fire extinguishing system comprising a housing that encloses a detection assembly for detecting a fire and a dispensing assembly for ejecting fire extinguishing balls towards a fire.

Yet another object of the present invention is to provide a new and improved fire extinguishing system comprising a detection assembly having one or more sensors, a microprocessor, and a speaker system.

Still yet another object of the present invention is to provide a new and improved fire extinguishing system, wherein the dispensing assembly is configured to eject a plurality of fire extinguishing balls directionally towards a fire.

Yet a further object of the present invention is to provide a new and improved fire extinguishing system wherein the dispensing assembly further comprises a rotating actuator configured to rotate the barrel to align an end of the barrel with the sensor to allow the plurality of fire extinguishing balls to be directionally ejected towards the fire.

Still yet another object of the present invention is to provide a new and improved fire extinguishing system wherein the device may be readily fabricated from materials that permit relative economy and are commensurate with durability.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein the numeral annotations are provided throughout.

DETAILED DESCRIPTION OF THE INVENTION

Figure 1:
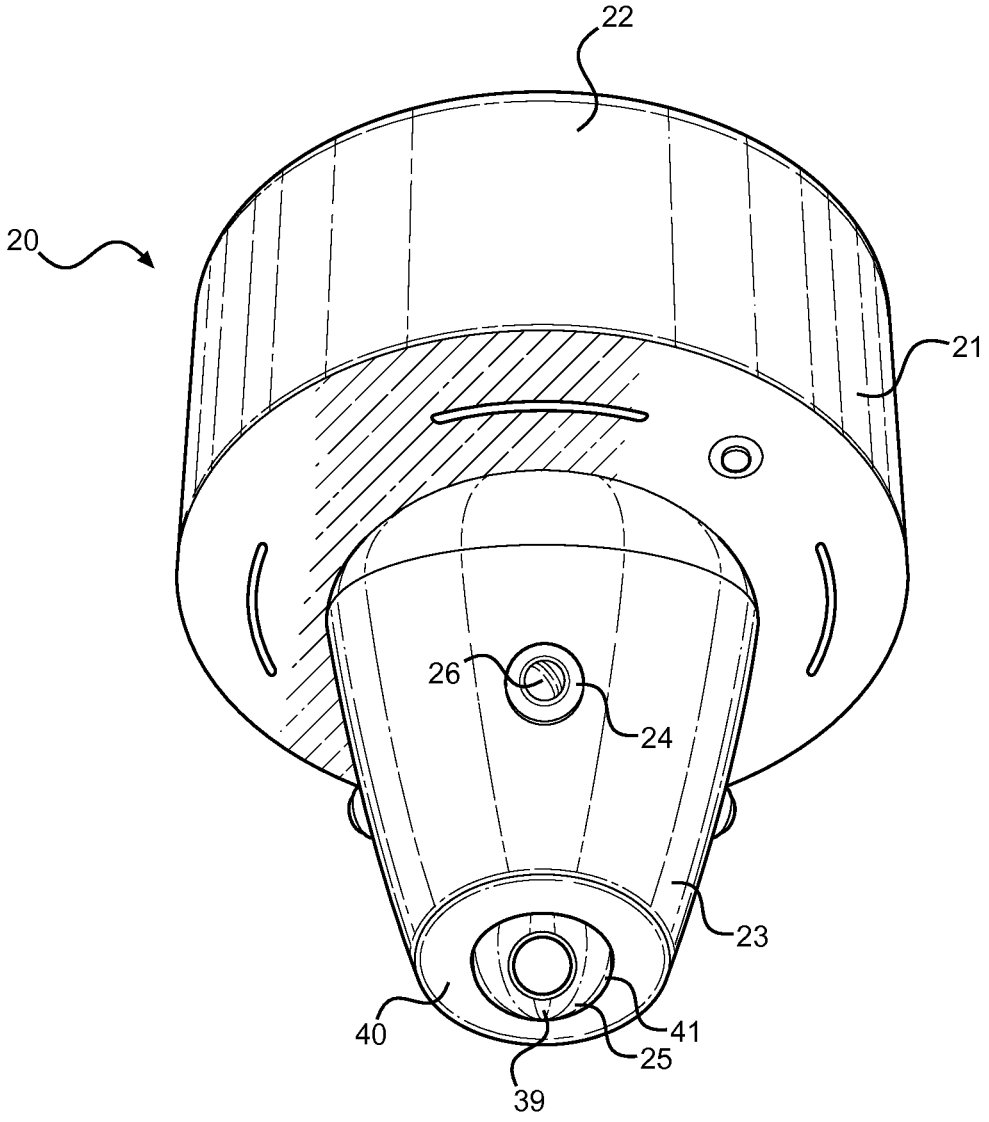
FIG. 1 shows a side perspective of the present invention.

References are made herein to the attached drawings. Like reference numerals are used throughout the drawings to depict like or similar elements of the fire extinguishing system. For the purposes of presenting a brief and clear description of the present invention, the preferred embodiment will be discussed as used to alert people within the vicinity of a nearby fire and dispense fire extinguishing balls towards the fire. The figures are intended for representative purposes only and should not be considered to be limiting in any respect.

Figure 2:
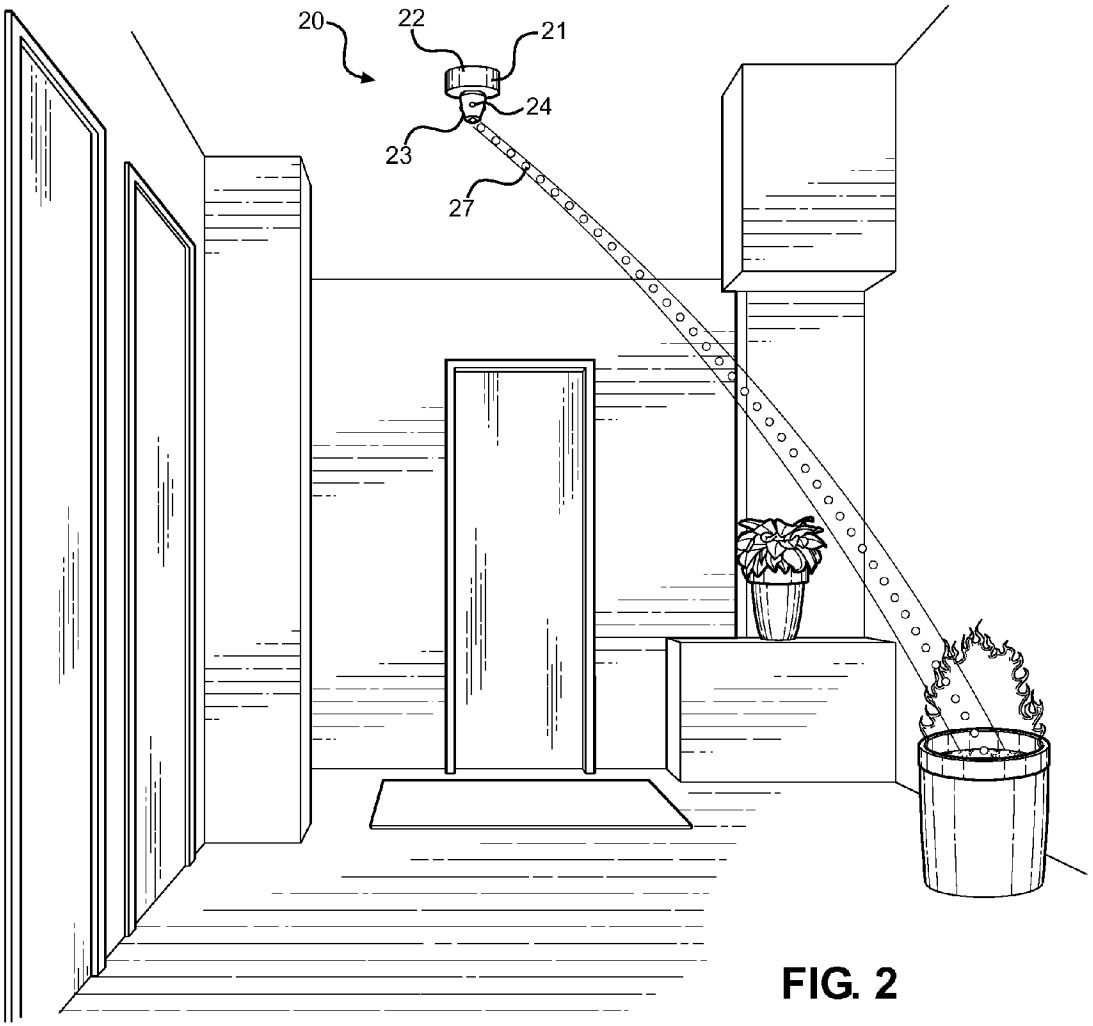
FIG. 2 shows a perspective view of the present invention in use.

Referring now to FIGS. 1 and 2, there are shown views of the fire extinguishing system. The fire extinguishing system 20 comprises a housing 21 having a base portion 22 and a conical portion 23 extending outwardly and downwardly therefrom. The conical portion 23 is preferably centrally located on the base portion 22, however, it is contemplated that the conical portion 23 can be affixed in other suitable locations as readily envisioned by those of ordinary skill in the art having the present disclosure. It is likewise contemplated that other shapes and sizes for the conical portion 23 are also appropriate. In addition, the base portion 22 is preferably cylindrical in shape, wherein a rear side of the base portion 22 includes an adhesive or another similar fastener that is configured to removably attach the base portion 22 to a support surface.

The fire extinguishing system 20 can be used in any of various locations. In the illustrated embodiment, the fire extinguishing system 20 is shown as being secured to a ceiling of a room, such as within a house or office. However, the fire extinguishing system 20 can similarly be used in outdoor or public spaces, such as parks, among others. The fire extinguishing system 20 can be mounted to vehicles such as planes. Further, the fire extinguishing system 20 can be utilized in factories, warehouses, power plants, and the like.

The base portion 22 and the conical portion 23 form an interior volume configured to support a detection assembly 24 and a dispensing assembly 25. The detection assembly 24 comprises at least one sensor 26 configured to detect a fire. Preferably, the sensor 26 comprises an infrared sensor. The detection assembly 24 further comprises a microprocessor and a speaker system, which allows for an audible alarm to be emitted to warn a user of an emergency situation when the sensor detects smoke. Once the detection assembly 24 detects a fire, the dispensing assembly 25 is configured to eject a plurality of fire extinguishing balls 27 filled with fire suppressant through a barrel 39 towards the fire.

The conical portion 23 further includes an apex 40 having an opening configured to receive the barrel 39 therethrough. The barrel 39 is configured to extend downwardly and perpendicularly in relation to the base portion 22. The barrel 39 is cylindrical in shape having a first end and a second end 41. The dispensing assembly 25 is configured to eject fire extinguishing balls 27 through the second end 41 towards a fire detected by the sensor 26.

Generally, these fire extinguishing balls 27 are thrown or rolled into the flames of a fire, where the plurality of fire extinguishing balls 27 will activate and spread preferably, a dry powdered fire suppressant. Preferably, the dry powdered fire suppressant filled within the fire extinguishing balls 27 is mono-ammonium phosphate, however, other suitable non-toxic alternatives are likewise contemplated. The fire extinguishing balls 27 comprise an activation strip embedded within the ball's outer casing, which securely holds the fire suppressant inside. When the activation strip is exposed to flames or elevated temperatures for more than a few seconds, the casing will burst open and disperse a cloud of the fire suppressant in the immediate vicinity. In this way, the fire extinguishing balls 27 are particularly advantageous for fire protection for homeowners, which require little to no human intervention.

Figure 3:
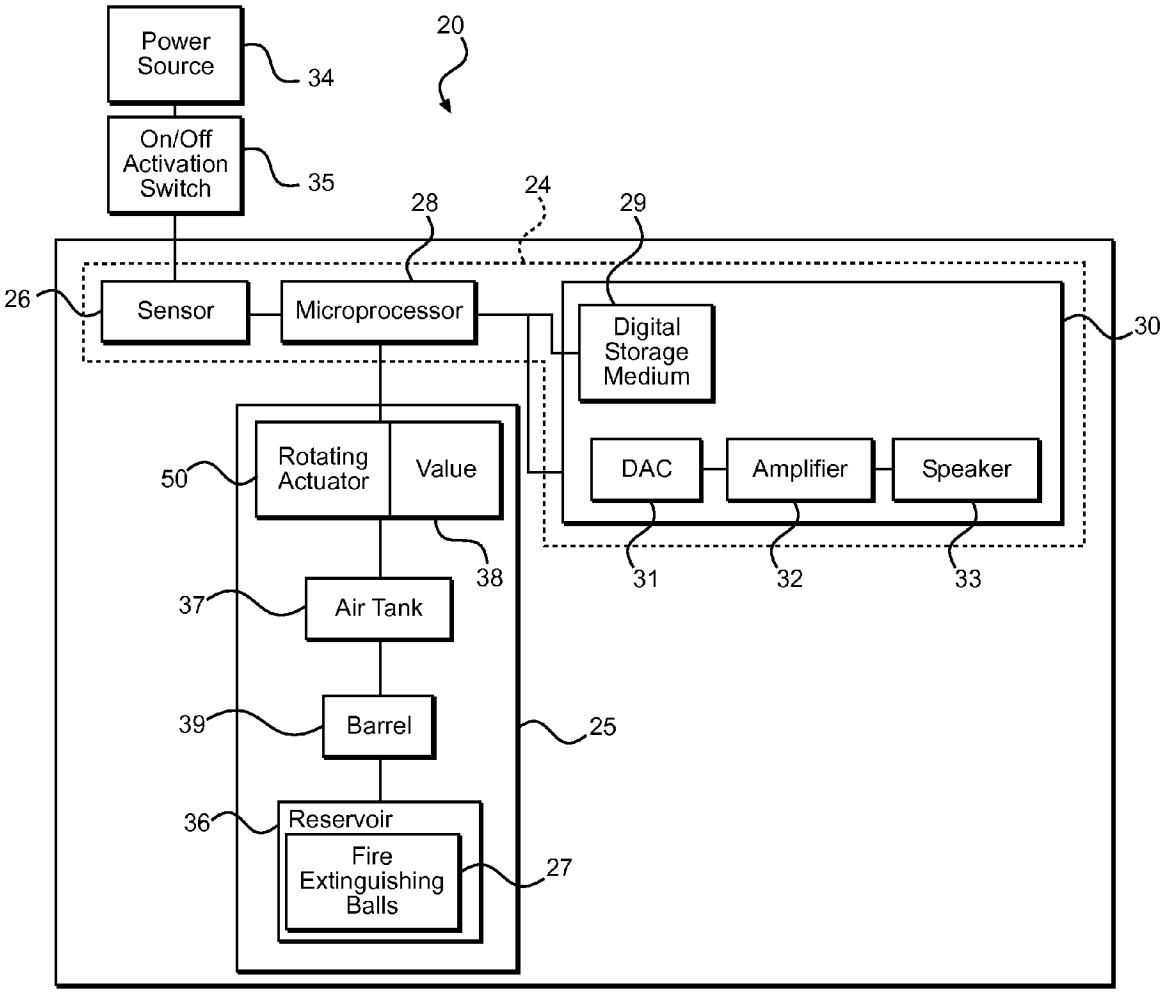
FIG. 3 shows a schematic diagram of the present invention.

Referring now to FIG. 3, there are shown a schematic diagram of the fire extinguishing system 20. The fire extinguishing system 20 comprises a detection assembly 24 and a dispensing assembly 25. The fire extinguishing system 20 comprises a power supply 34, such as one or more batteries. However, other power sources are used in alternate embodiments, such as a power cord plugged into a standard electrical outlet.

The detection assembly 24 comprises at least one sensor 26, a microprocessor 28, and a speaker system. The sensor 26 is preferably an infrared sensor adapted to detect elevated temperatures associated with fire. The infrared sensor is thus able to determine the size and extent of the fire, and whether the fire has been extinguished. Alternatively, the sensor 26 may be configured to detect smoke, which is generally an indicator of a fire. In such embodiments, the sensor 26 is a photoelectric smoke detector or an ionization smoke detection. Preferably, a plurality of sensors 26 are evenly spaced on the housing of the fire extinguishing device 20 so as to increase the sensitivity of the fire extinguishing device 20.

Each sensor 26 is electrically connected to the microprocessor 28, wherein each sensor is configured to transmit a digital signal to the microprocessor 28 upon detection of a fire. The microprocessor 28 is also electrically coupled to a digital storage medium 29, wherein the microprocessor 28 is configured to retrieve a digital alert file from the digital storage medium 29 and transmit the digital alert file to the speaker system 30. The digital storage medium 29 is preferably a Random Access Memory (RAM) or a hard drive, however, other suitable alternatives are used in other embodiments. The microprocessor 28 functions primarily as a conduit between the sensors 26 and the speaker system 30.

The speaker system 30 comprises a digital-to-analog converter (DAC) 31, an amplifier 32, and a speaker 33. The digital alert file transmitted from the microprocessor 28 is converted into an analog signal by the DAC 31, which is its primary function. The amplifier 32 intensifies the generally low powered analog signal from the DAC 31 to a level suitable for driving the speaker 33. Generally, the analog signal inputted to the amplifier 32 may only be a few hundred microwatts, however, the amplifier can output tens to hundreds of watts based on preference. The speaker 33 receives the analog signal from the amplifier 32 and plays the digital alert file stored within the digital storage medium 29 to sound an audible alarm configured to alert people within the vicinity of an emergency.

In some embodiments, the fire extinguishing system 20 further comprises a wireless transmitter adapted to send a signal to a user's mobile device, such as a cell phone, laptop, tablet or other device in the event of a fire. This allows the user to respond to the fire and to call for help. The notification may also help to alert the user if he or she is near the fire but is otherwise unaware of the fire. Thus, the mobile device is adapted to be paired to the fire extinguishing system 20 so as to allow communication therewith.

In some embodiments, the detection assembly 24 further comprises an on/off activation switch 35 that is configured to provide electrical communication between the power source 34 and the detection assembly 24. Preferably, the on/off activation switch 35 is a standard rocker switch, however, other suitable switches, such as depressible buttons and toggle switches, are likewise contemplated. The on/off activation switch 35 is configured to deactivate the detection assembly 24 to facilitate any adjustments needed, such as moving the fire extinguishing system 20 to another location or the changing of the power source 34.

Furthermore, the microprocessor 28 is also electrically connected to the dispensing assembly 25 that is configured to eject fire extinguishing balls 27 towards the direction of the fire. The dispensing assembly 25 comprises a reservoir 36, an air tank 37 filled with compressed air, a valve 38, and a barrel 39. The reservoir 36 is configured to support a plurality of the fire extinguishing balls 27 and load the plurality of fire extinguishing balls 27 within the barrel 39 one at a time. It is not desired to limit the shape and size of the reservoir 36 of the dispensing assembly 25. Rather, it is desired to disclose and claim a functional reservoir 36 configured to support the fire extinguishing balls and obtain the results and advantages described in this present disclosure. These modifications and variations are deemed within the scope and spirit of the inventive embodiments described herein.

Upon detection of fire by the sensor 26, each sensor 26 is configured to transmit a signal to the microprocessor 28, wherein the microprocessor 28 is prompted to actuate a valve 38, wherein the valve 38 is in air communication with the air tank 37. In this way, compressed air supported within the air tank 37 is released into the barrel 39 and the fire extinguishing ball 27 lodged within the barrel 39 is pushed in front by the compressed air and thereby ejected towards the fire. The fire extinguishing balls 27 are continually dispensed until the fire has been eliminated. Fire extinguishing balls 27 no longer released when the infrared sensor determines that there is no longer elevated temperatures associated with a fire.

In some embodiments, the microprocessor 28 is also electrically connected to a rotating actuator 50. The rotating actuator 50 is configured to extend the barrel 39 downwardly to allow for the plurality of fire extinguishing balls to be ejected through the second end of the barrel. The rotating actuator 50 also is configured to rotate the barrel 39 so that the second end of the barrel 39 aligns with the sensor 26 that first detected smoke. In this way, the plurality of fire extinguishing balls 27 can be directionally projected towards the location of the fire. Preferably, the rotating actuator 50 is an electromechanical rotating actuator, however, the type, size or shape of the electromechanical rotating actuator is not contemplated. The purpose of this disclosure is disclose and claim a functional rotating actuator 50 that is configured to obtain the results and advantages disclosed herein. It is contemplated that these modifications and variations are deemed within the scope of the inventive embodiments of this disclosure.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above descriptions then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A fire extinguishing system, comprising:

a housing supporting a detection assembly and a dispensing assembly;

said detection assembly comprising at least one sensor configured to detect a fire, a microprocessor, and a speaker system adapted to emit an audible alarm;

said microprocessor is electrically connected to said dispensing assembly;

said dispensing assembly configured to eject a plurality of fire extinguishing balls towards said fire.

2. The fire extinguishing system of claim 1, wherein:

said dispensing assembly comprising a reservoir, an air tank filled with compressed air, a valve, and a barrel.

3. The fire extinguishing system of claim 2, wherein:

said reservoir configured to support said plurality of fire extinguishing balls and successively load said plurality of fire extinguishing balls within said barrel one at a time.

4. The fire extinguishing system of claim 2, wherein said at least one sensor is configured to detect smoke and transmit a signal to said microprocessor.

5. The fire extinguishing system of claim 2, wherein:

said microprocessor configured to actuate said valve upon detection of said signal;

wherein said valve is in air communication with said air tank, whereby said compressed air is released from said air tank and propels one of said plurality of fire extinguishing balls lodged within said barrel through said barrel to be ejected towards a fire.

6. The fire extinguishing system of claim 1, wherein said sensor includes a photoelectric smoke detector or an ionization smoke detector.

7. The fire extinguishing system of claim 2, wherein:

said dispensing assembly further comprising a rotating actuator electrically connected to said microprocessor and said barrel;

wherein said rotating actuator configured to extend said barrel downwardly to allow ejection of said plurality of fire extinguishing balls through an end of the barrel and rotate said end of said barrel to align with said at least one sensor to allow said plurality of fire extinguishing balls to be directionally ejected towards said fire.

8. The fire extinguishing system of claim 1, wherein said housing includes a cylindrical base portion and a conical portion extending outwardly and perpendicularly from said base portion.

9. The fire extinguishing system of claim 8, wherein said conical portion includes an apex having an opening;

wherein said opening is configured to receive said barrel therethrough;

said barrel is configured to extend downwardly and perpendicularly in relation to said base portion.

10. The fire extinguishing system of claim 1, wherein said speaker system comprises a digital storage medium, a digital-to-analog converter, an amplifier, and a speaker.

11. The fire extinguishing system of claim 10, wherein said digital storage medium is configured to store a digital alert file used to drive said speaker system.

12. The fire extinguishing system of claim 10, wherein:

said microprocessor, upon receipt of said signal from said sensor, is also configured to retrieve said digital alert file from said digital storage medium and transmit said digital alert file to said speaker system;

wherein said speaker plays said digital alert file as long as said sensor detects said smoke.

13. The fire extinguishing system of claim 1, said detection assembly further comprising an on/off activation switch configured to provide electrical communication between said power source and said detection assembly.

14. The fire extinguishing system of claim 1, wherein said plurality of fire extinguishing balls enclose a powdered fire suppressant.

15. The fire extinguishing system of claim 14, wherein said powdered fire suppressant includes mono-ammonium phosphate.

* * * * *